US008328694B2

(12) United States Patent
Barre et al.

(10) Patent No.: US 8,328,694 B2
(45) Date of Patent: Dec. 11, 2012

(54) TRAINING METHOD

(75) Inventors: Lara Barre, Rotterdam (NL); Andres Garcia, Leuven (BE); Nikolaj Groeneweg, Amsterdam (NL); Jillis Ter Hove, Arnhem (NL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/455,531

(22) Filed: Apr. 25, 2012

(65) Prior Publication Data

US 2012/0208157 A1 Aug. 16, 2012

Related U.S. Application Data

(60) Continuation of application No. 12/905,433, filed on Oct. 15, 2010, which is a division of application No. 11/942,054, filed on Nov. 19, 2007, now Pat. No. 7,815,548.

(30) Foreign Application Priority Data

Dec. 21, 2006 (EP) ..... 06126818

(51) Int. Cl.
*A63B 71/00* (2006.01)

(52) U.S. Cl. ..... 482/9; 482/8

(58) Field of Classification Search ..... 482/1–9; 600/300, 595; 702/182
See application file for complete search history.

(56) References Cited

U.S. PATENT DOCUMENTS 4,867,442 A 9/1989 Matthews
4,911,427 A 3/1990 Matsumoto et al.
5,435,320 A 7/1995 Seitz
5,830,158 A 11/1998 Zanakis
5,980,429 A 11/1999 Nashner
6,059,576 A 5/2000 Brann
6,159,147 A 12/2000 Lichter et al.
6,167,362 A 12/2000 Brown et al.
6,190,287 B1 2/2001 Nashner
6,409,685 B1 6/2002 Merzenich et al.
6,440,068 B1 8/2002 Brown et al.

(Continued)

FOREIGN PATENT DOCUMENTS

WO 2006104478 A1 10/2006

OTHER PUBLICATIONS

Notice of Allowance (Mail Date Jun. 11, 2010) for U.S. Appl. No. 11/942,054, filed Nov. 19, 2007; Confirmation No. 1884.

(Continued)

*Primary Examiner* — LoAn H. Thanh
*Assistant Examiner* — Sandhara Ganesan
(74) *Attorney, Agent, or Firm* — Schmeiser, Olsen & Watts; John Pivnichny

(57) ABSTRACT

A training method in which training coordinator device is in communication with a training transducer integrated in an exercise article. The training coordinator device receives training schedule data, for example, via an internet link, and uses this schedule to prompt and encourage a user in performing training activities in a real time and persistent manner defined in the training schedule by means of a user interface which may take the form of an LED array. The training coordinator device monitors training activities by signals from a suitably adapted training transducer, which may be integrated in an exercise article such as a bicycle etc. Information concerning the user's training activities may be published via an internet link for access by both the user and medical professionals, who may also be the source of the training schedule.

10 Claims, 4 Drawing Sheets

U.S. PATENT DOCUMENTS

| | | | |
|---|---|---|---|
| 6,478,736 | B1 | 11/2002 | Mault |
| 6,513,532 | B2 | 2/2003 | Mault et al. |
| 6,571,200 | B1 | 5/2003 | Mault |
| 6,623,358 | B2 | 9/2003 | Harima |
| 6,632,158 | B1 | 10/2003 | Nashner |
| 6,699,188 | B2 | 3/2004 | Wessel |
| 7,172,530 | B1 | 2/2007 | Hercules |
| 7,275,986 | B2 | 10/2007 | Mori et al. |
| 7,815,548 | B2 | 10/2010 | Barre et al. |
| 2001/0041647 | A1 | 11/2001 | Itoh et al. |
| 2002/0045519 | A1 | 4/2002 | Watterson et al. |
| 2002/0077219 | A1 | 6/2002 | Cohen et al. |
| 2002/0107433 | A1 | 8/2002 | Mault |
| 2002/0128119 | A1 | 9/2002 | Arai |
| 2002/0165067 | A1 | 11/2002 | Watterson et al. |
| 2003/0224337 | A1 | 12/2003 | Shum et al. |
| 2004/0014567 | A1 | 1/2004 | Mendel |
| 2004/0077462 | A1 | 4/2004 | Brown et al. |
| 2004/0229729 | A1 | 11/2004 | Albert et al. |
| 2005/0209049 | A1 | 9/2005 | Shields |
| 2006/0025282 | A1 | 2/2006 | Redmann |
| 2008/0153672 | A1 | 6/2008 | Barre et al. |
| 2011/0034301 | A1 | 2/2011 | Barre et al. |

OTHER PUBLICATIONS

Nuria Oliver & Fernando Flores-Mangas, MPTrain: A Mobile, Music and Physiology-Based Personal Trainer, Microsoft Research Technical Report MSR-TR-2006-31; Mar. 2006. 17 pages.

Web page describing Disco-mood ball. [online]. 1 page. [retrieved Sep. 2, 2007]. Retrieved from the Internet: < URL: http://www.halfbakery.com/idea/Disco-mood_20ball >.

Hughes; Review of Motion Lingo ADEO GPS Fitness Trainer. [online]. 15 pages. [retrieved Sep. 2, 2007]. Retrieved from the Internet: < URL: http://the-gadgeteer.com/review/motion_lingo_adeo_gps_fitness_trainer >.

Advertising sheet for TDK Systems exercise machine with Bluetooth wireless technology. 2004. 1 page.

Office Action (Mail Date Jan. 23, 2009) for U.S. Appl. No. 11/942,054, filed Nov. 19, 2007; Confirmation No. 1884.

Amendment filed Jul. 22, 2009 in response to Office Action (Mail Date Jan. 23, 2009) for U.S. Appl. No. 11/942,054, filed Nov. 19, 2007; Confirmation No. 1884.

Final Office Action (Mail Date Oct. 5, 2009) for U.S. Appl. No. 11/942,054, filed Nov. 19, 2007; Confirmation No. 1884.

Request for Continued Examination and Amendment filed Dec. 30, 2009 in response to Office Action (Mail Date Jan. 23, 2009) for Patent Application No. 11/942,054; Filing Date Nov. 19, 2007; Confirmation No. 1884.

Office Action (Mail Date Jun. 24, 2011) for U.S. Appl. No. 12/905,433, filed Oct. 15, 2010; Confirmation No. 7959.

Amendment filed Sep. 26, 2011 in response to Office Action (Mail Date Jun. 24, 2011) for U.S. Appl. No. 12/905,433, filed Oct. 15, 2010; Confirmation No. 7959.

Final Office Action (Mail Date Dec. 6, 2011) for U.S. Appl. No. 12/905,433, filed Oct. 15, 2010; Confirmation No. 7959.

Amendment after Final filed Jan. 31, 2012 in response to Final Office Action (Mail Date Dec. 6, 2011) for U.S. Appl. No. 12/905,433, filed Oct. 15, 2010; Confirmation No. 7959.

Notice of Allowance (Mail Date Feb. 16, 2012) for U.S. Appl. No. 12/905,433, filed Oct. 15, 2010; Confirmation No. 7959.

TRAINING METHOD

This application is a continuation application claiming priority to Ser. No. 12/905,433, filed Oct. 15, 2010, which is a divisional application claiming priority to Ser. No. 11/942,054, filed Nov. 19, 2007; which claims priority from EPO Application Serial No. 06126818.1 filed Dec. 21, 2006 and entitled TRAINING COORDINATOR DEVICE AND METHOD.

FIELD OF THE INVENTION

This invention relates generally to the field of training, and more particularly to the monitoring of physical activity and encouraging of desirable actions.

BACKGROUND OF THE INVENTION

Due to the demographic trends of recent decades, the population of the world's larger economies is aging. Since aging generally brings both a deterioration in physical fitness generally, and a reduction in the human bodies capacity for repair, the demand for fitness training, physiotherapy and other training for the human body is on the rise.

The financial stakes in professional athletics continue to rise, as a result of globalization and the worldwide media market. With this trend comes an increasing pressure on athletes both to excel in their particular athletic activity, and to be available to compete with growing frequency. It may be imagined for these reasons also that the demand for fitness training, physiotherapy and other training for the human body is on the rise.

Growing public awareness of health issues such as diet, the dangers of smoking and in particular the need for regular exercise over recent years may be expected to give rise to a growing demand for assistance in properly and regular undertaking suitable exercise.

In view of all of the above considerations, certain training devices have been proposed.

U.S. Published Application No. 2004/0014567 (Mendel) entitled "Feedback System For Monitoring And Measuring Physical Exercise Related Information" discloses a system for advising an exerciser about his physical activities, associated either with displacement of the exerciser itself or of an object displaced by the exerciser, or an object displaced simultaneously with the exerciser. The system includes a first unit for monitoring the activities. This unit is not in physical contact with the exerciser or the object, displaced by the exerciser. The first unit is capable to collect raw data defining the activities either in terms of distance or acceleration. The first unit transmits the collected raw data in a wireless fashion to a second unit, which receives the transmitted raw data, processes it and calculates various parameters, defines the physical activities, and represents the calculated parameters in a form recognizable by the exerciser. The system enables tracking, recording and updating the relevant information, provides improved feedback and thus helps to the exercising individual to improve his performances.

U.S. Pat. No. 6,059,576 (Brann) entitled "Training And Safety Device, System And Method To Aid In Proper Movement During Physical Activity" discloses an electronic device, system and method to monitor and train an individual on proper motion during physical movement. The system employs an electronic device which tracks and monitors an individual's motion through the use of an accelerometer capable of measuring parameters associated with the individual's movement. The device also employs a user-programmable microprocessor which receives, interprets, stores and responds to data relating to the movement parameters based on customizable operation parameters, a real-time clock connected to the microprocessor, memory for storing the movement data, a power source, a port for downloading the data from the device to other computation or storage devices contained within the system, and various input and output components. The downloadable, self-contained device can be worn at various positions along the torso or appendages being monitored depending on the specific physical task being performed. The device also detects the speed of movements made while the device is being worn. When a pre-programmed recordable event is recognized, the device records the time and date of the occurrence while providing feedback to the wearer via visual, audible and/or tactile warnings.

U.S. Published Application No. 2006/0025282 (Redmann) entitled "Device And Method For Exercise Prescription, Detection Of Successful Performance, And Provision Of Reward Therefore" concerns an exercise computer that monitors the exercises of a user and provides rewards for exercises done well and regularly, thereby motivating the user. Rewards take the form of video games, cartoons, music, and merchant coupons. The exercise computer also provides encouragement and advice as the user progresses in skill level. Exercises may be prescribed. A record of exercise performance can be produced, to track the user's progress over time. The system and method can readily utilize the current install base of handheld computers and video games pre-existing in the marketplace.

SUMMARY OF THE INVENTION

Briefly stated, a training coordinator device is in communication with a training transducer integrated in an exercise article. The training coordinator device receives training schedule data, for example, via an internet link, and uses this schedule to prompt and encourage a user in performing training activities in a real time and persistent manner defined in the training schedule by means of a user interface which may take the form of an LED array. The training coordinator device monitors training activities by signals from a suitably adapted training transducer, which may be integrated in an exercise article such as a bicycle etc. Information concerning the user's training activities may be published via an internet link for access by both the user and medical professionals, who may also be the source of the training schedule.

According to an embodiment of the invention, a training device includes a first interface adapted to receive signals from a training transducer; a second interface adapted to receive training schedule data from a remote correspondent, the training schedule data defining times by which specified activities are to be performed by a user; a first memory adapted to store the training schedule data; a first output adapted to output a human perceptible signal as a function of status data from both the first output and a feedback template; a clock; and a processor, the processor configured to continuously (a) carry out a determination in real time of whether the signals received at the first interface satisfy criteria derived from the training schedule with regard to a value of the clock; (b) update the status data, so as to output a representation as a result of the determination; and (c) update the training schedule data as a function of a result of the determination; regardless of whether training activities are currently taking place.

According to an embodiment of the invention, a method of training includes the steps of (a) receiving training schedule data from a remote correspondent at a second interface, the training schedule data defining times by which specified activities are to be performed by a user; (b) storing the training schedule data in a first memory; and (c) continuously carrying out the steps of (i) determining in real time whether signals received from a training transducer via a first interface satisfy criteria derived from the training schedule with regard to the value of a clock; (ii) outputting a human perceptible signal as a function of the results of both the step of determining and a feedback template; and (iii) updating the training schedule data as a function of results of the step of determining.

According to an embodiment of the invention, a program product includes program codes stored in a computer readable storage medium, the program codes implementing the steps of: (a) receiving training schedule data from a remote correspondent at a second interface, the training schedule data defining times by which specified activities are to be performed by a user; (b) storing the training schedule data in a first memory; and (c) continuously carrying out the steps of (i) determining in real time whether signals received from a training transducer via a first interface satisfy criteria derived from the training schedule with regard to the value of a clock; (ii) outputting a human perceptible signal as a function of the results of both the step of determining and a feedback template; and (iii) updating the training schedule data as a function of results of the step of determining.

DETAILED DESCRIPTION OF THE PREFERRED EMBODIMENT

Certain embodiments concern a motivation and compliance enhancing system that registers actions made by the user on a training coordinator device for example through wireless communication, and gives feedback on nature and correctness of these actions, and optionally transfers data regarding the training activity through wireless methods to a system that is accessible to the user and the healthcare professional through the web.

Figure 1:
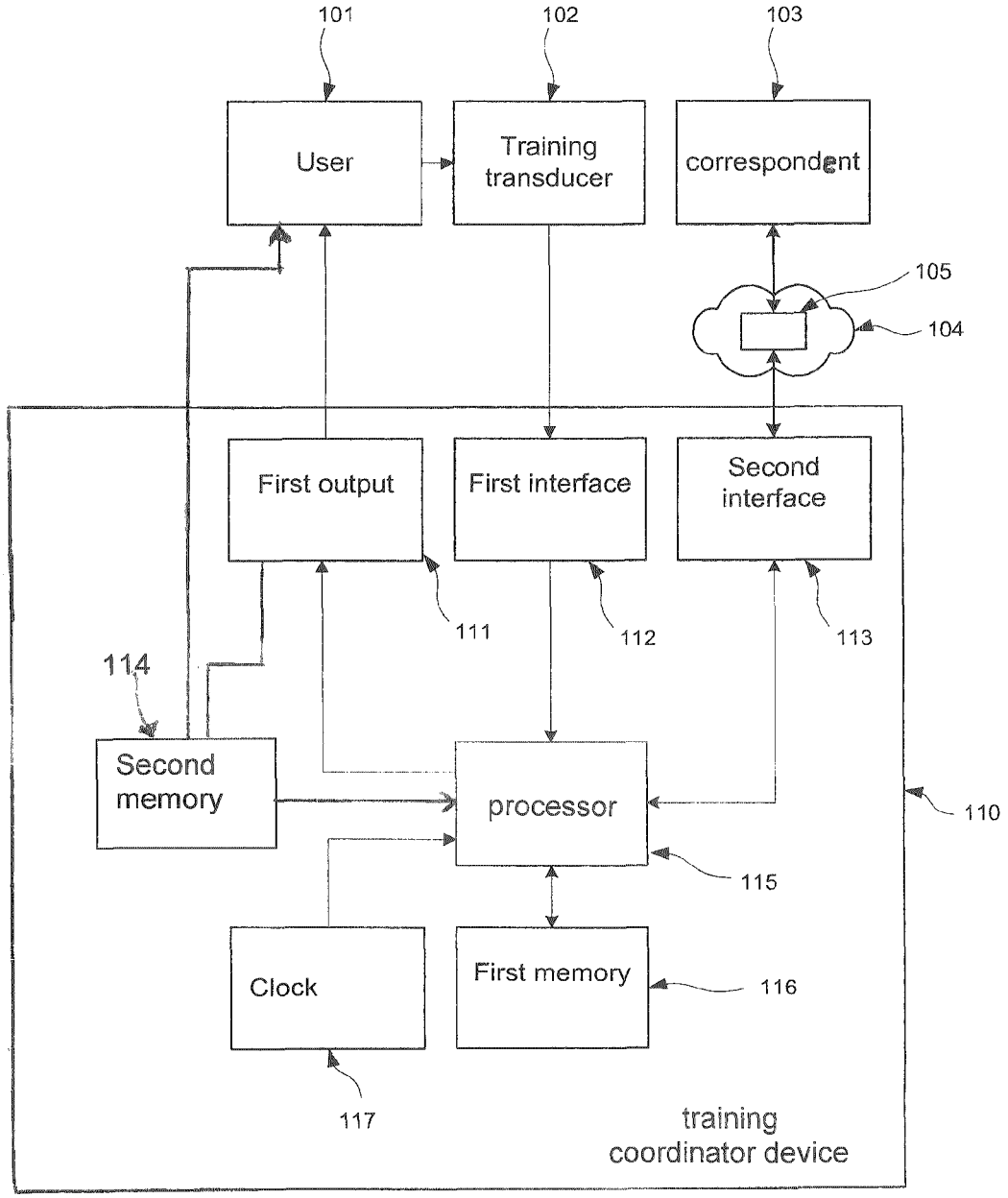
FIG. 1 shows a first embodiment of the present invention.

FIG. 1 shows a first embodiment of the present invention. As shown in FIG. 1, there is provided a training coordinator device 110 including a first output 111, a first interface 112, a second interface 113, a first memory 116, a second memory 114, a clock 117, and a processor 115. The training coordinator device 110 is in communication with a user 101, a training transducer 102, and a correspondent 103. As shown in FIG. 1, the user 101 is furthermore interactively engaged with training transducer 102. As shown, an Internet 104 and a website 105 forming part of Internet 104 are interposed between the second interface 113 and the correspondent 103 so as to provide a means of communication.

Specifically, the processor 115 is in bidirectional communication with first interface 112, second interface 113, and first memory 116. The processor 115 is furthermore connected to transmit information to the first output means 111. The processor 115 is connected to receive information from the clock 117. The first output 111 preferably outputs information in a form receivable by user 101. The first interface 112 is adapted to receive information for the training transducer 102. The second interface 113 is adapted for bidirectional communication with the correspondent 103 via the Internet 104.

In operation, the remote correspondent 103 provides training schedule data defining times by which specified activities are to be performed by the user 101. This information is stored in the first memory 116. A second memory 114 may store status data from the first output 111, which, when applied to the first output 111, produces a human perceptible signal as a function of the first output 111 status data and a feedback template, as an alternative to continuously updating the status of the output.

Processor 115 determines in real time whether data received from the first interface 112 satisfy criteria derived from the training schedule with regard to the value of the clock 117. In other words, the processor 115 determines whether or not the user 101 is performing the exercises defined in the training schedule satisfactorily and on time. The processor 115 further updates the first output 111 status data, which in turn causes the first output 111 to output a representation of the determination to the user 101. The user 101 is thus notified of the determination, that is to say, whether or not he/she is up to date with his or her training schedule for example. The processor 115 updates the training schedule data as a function of the determination, and transmits information identifying the user 101 or training device and one or more of: (a) the data received from first interface 112, (b) the status data, (c) the results of the determination, or (c) an updated portion of the training schedule, via the second interface 113 to the remote correspondent 103. The remote correspondent 103 is preferably a physiotherapist or similar medical practitioner, and as such is qualified to set and assess training schedule data on the basis of the user's particular needs.

Updating the training schedule data may entail a modification of the training schedule itself, or may simply mean storing the result of the determination so that in future the training schedule may be interpreted with reference to past determination information.

The first output 111 may include any type of transducer producing a human detectable signal. For example, the first output 111 may include an audio transducer, may generate warmth, vibration etc. Where an audio transducer is used, the human detectable signal may include pre-recorded or synthesized voice communication, music, or arbitrary sound effects. One or all of such devices may be used in combination.

The first output 111 preferably includes a luminous transducer such as an LED or an array of LEDs. Where the luminous transducer includes a plurality of elements, these may be controlled responsive, for example, to the contents of second memory 114 as described hereafter to cycle through a sequence, which may achieve the effect of simulating movement from the point of view of the user. Where the luminous transducer includes a plurality of elements, these may be adapted to emit light signals of different respective colors. These may be controlled responsive to the contents of the second memory 114 to cycle through a sequence, which may achieve the effect of simulating movement from the point of view of the user, and of a change of the overall output color.

As mentioned above, the first output 111 preferably outputs a human perceptible signal as a function of the value of the first output 111 status data and the feedback template. The feedback template may be nothing more than the minimum means necessary to convert the first output 111 status data into a human perceptible signal, but may also introduce the possibility of setting preferences for the way in which the conversion is carried out, and in particular the manner in which information is conveyed to the user. This may for example impose certain color schemes, musical resources, voice patterns etc, depending on the type of output transducer in question. Advantageously, the user may be able to choose the feedback template, either by direct manipulation of the training coordinator device, or via the second interface, for example via an internet interface. Predefined templates may be offered for use, for example by download over the internet.

The training coordinator device 110 may be integrated in a housing of translucent material such as a silicone rubber. Such a material offers the advantages of protecting the functional elements of the training coordinator device 110 from physical shock as well as the ingress of water or other foreign material which may lead to undesired operation. In a case where the first output mean takes the form of a luminous transducer, a still further advantage lies in the fact that the translucent material will tend to diffuse the light emitted thereby, so that the entire device appears to glow in a pleasing manner. Where the first output 111 includes luminous transducer elements adapted to emit light signals of different colors, the translucent material will tend to merge and blend the colors, thereby substantially extending the range of colors that may be produced from the point of view of the external user.

The training coordinator device 110 may be substantially ovoid in shape. This form has been found to be advantageous in facilitating an even radiation of human perceivable stimuli and radio signals, without the need for fragile and unsightly projections.

The training transducer 102 includes means capable of detecting an exercise activity of the user 101. A non-exhaustive list of suitable devices may include GPS, gyroscopes, accelerometers, pressure switches or other transducer means as will readily occur to one having ordinary skill in the art. The training transducer 102 also preferably includes a transmitter (not shown) capable of relaying information from the transducer 102 to the first interface 112. The transducer 102 and transmitter may form an integral part of an exercise article such as a weighing scale, pedometer, heart rate monitor, bicycle (fixed or free), balance ball or plate, skipping rope, weights machine, etc. Alternatively the training transducer 102 may take the form of a general purpose module which may be affixed to a variety of exercise articles or indeed to the user 101 directly, as required depending on the exercise activity in question.

Different exercise articles may generally be intended for use in a particular way. For the training coordinator device 110 to correctly interpret information received from the training device, and on the basis of this information to provide meaningful feedback to the user 101, it may be helpful for information defining the exercise article to be provided. Thus every exercise article may be associated with a particular exercise article definition. Furthermore; a particular exercise article may be used in a number of ways, which may vary from the classic use of the article in question. This is even more the case for the use of the general purpose module described above. In such cases, it may also be helpful for information defining the planned activity for the device to be provided. According to certain embodiments, there is defined an electronic file article definition defining characteristics of an exercise article, for example based on the XML format. This may include a classification of the exercise article, and as a function of this classification, a variety of parameters describing the particular article. According to certain embodiments, this classification may take the form of an object oriented hierarchy exhibiting inheritance in the parameters of relevance. When the user 101 wishes to begin using a new exercise article, the article may be identified selecting the type (subclass) of the article in question, and then defining the relevant parameters, or by choosing from a list of particular devices for example by brand and model, for which parameters are already stored. These interactions may take place via the internet site 105 for example. Alternatively the training coordinator device 110 may be programmed by a local connection to an input device such as a keyboard, or via a local interface with another device such as a PC, a PDA or a mobile phone, or of course through an input belonging to the training coordinator device 110 itself.

According to certain embodiments, there may be provided specially adapted exercise articles which are able of communicating relevant parameters as discussed above to the training transducer 102 and thereby to the training coordinator device 110, or alternatively to the training coordinator device 110 directly.

The training coordinator device 110 may still further integrate learning features, whereby in a "learning mode" it is able to learn the characteristics of a new exercise device. This may involve instructing the user to perform particular actions having a known basis for reference, and calibrating future inputs on the basis of the received input.

Information concerning particular exercise articles gathered in any of the manners described above may be stored for future reference as a first set of parameters in the user device, or at the website, etc. It may be possible for the training coordinator device 110 to associate certain characteristics of signals received from the exercise article, or by a generic transducer device when associated with a particular exercise article or activity with particular sets of information, so as to automatically associate signals received from a particular training article with a particular training schedule.

With regard to a second set of parameters comprising the definition of planned activities as represented in the training schedule as discussed above, these may in general be defined by the correspondent 103, or by another party involved in the planning of a user's training program. It may be preferable for the details of the exercise articles available to the user 101 to be available to the individual planning the training program, so as to design a program compatible with the available equipment. It may also be desirable for software running at the training coordinator device 110, at the website or elsewhere to automatically determine a training schedule as a function of information about available exercise equipment, stated training goals and other information concerning the user 101 such as their present status in the context of the proposed training regime, e.g., age, weight, present fitness status etc. Predefined programs may be available for particular purposes, such as weight loss, cardiovascular training, hand—eye coordination, reconditioning after an accident or operation etc., which may be modified as a function of available exercise equipment and other information concerning the user such as their present status in the context of the proposed training regime, e.g. age, weight, present fitness status etc., either automatically or with the intervention of a medical professional, fitness adviser etc.

A third set of parameters may define the way in which information is presented to the user 101. These parameters may be referred to as defining a behavior template. Information received from the exercise article will be interpreted as a function of the information defining the exercise article as discussed above, and compared to relevant parts of the training schedule, to determine a response for presentation to the user 101, i.e., by the first interface 112. This response is determined by reference to the third set of parameters. These may define reactions such as different light patterns, vibrations, noises, etc. when for example a threshold defined in the training schedule is exceeded by a signal from the exercise device when filtered by the article characteristics defining the exercise article.

The behavior template for use for a particular training coordinator device 110 or for a particular user 101 may be selected by the user for example from a set predefined behavior templates, which may be proposed for example by the training coordinator device 110 or at the website 105. The user may also be permitted to modify or customize such predefined templates, or to define custom behavior templates from scratch.

The exercise article parameters, behavior template and training schedules may be stored in the first memory 116. Certain pieces of such data may be stored elsewhere, and retrieved as necessary for example by the second interface 113.

The results of a particular training session may be uploaded to the website 105, or otherwise submitted to the correspondent 103. In the example of FIG. 2 information to be submitted might include the start time and duration of the session, the maximum period for which perfect balance was achieved and the total time spent in a balanced state, etc.

The transducer transmitter and the first interface 112 may be configured to communicate according to any suitable means, for example infrared, sonic, radio etc. Advantageously communications may take place by means of Zigbee, Bluetooth or a similar short range radio protocol.

As described above, communications between the correspondent and the second interface 113 take place via the internet, for example via email, FTP, RSS or by means of an http interface. In some situations communications by means of a local or other network, for example by means of Ethernet or WiFi communication may be suitable. GPRS, UTMS or equivalent or paging, wireless through RF (802.1x), etc. may also be suitable. SMS messages transferred entirely or in part over a cellular telephone network may also be suitable. As shown in FIG. 1, internet web site 105 preferably forms a part of and is accessible by at least the training coordinator device 110 and the correspondent 103 via the internet 104. Still further, the internet site 105 may be accessible by other interested parties such as further medical practitioners, a trainer, or users themselves. A variety of degrees of access rights may be envisaged offering different users access to different functions as controlled for example by various passwords etc. as will readily occur to the skilled person.

According to certain embodiments, the first interface 112 may be adapted for bi-directional communication with the exercise article, so as to enable the training coordinator device 110 to control the exercise article. For example, in the case where the exercise article is a training bike, the training schedule may specify a particular sequence of resistance values, which the exercise article could automatically select at the required moment.

Information submitted to the correspondent 103, or information derived therefrom, may also be made available to the user 101, for example by an internet interface. The correspondent 103 may also perform the functions of storing the training schedule, storing the training results, and storing the configuration for the training coordinator device 110. The training coordinator device 110 functions may be accessible for example through a web browser for the user and medical professional The processor 115 may be a microprocessor running suitable software, or may take the form of application-specific integrated circuit (ASIC), or be built up from suitably connected standard elements, or include a suitably configured Field-programmable gate array (FPGA). The processor 115 may include a combination of any or all of the above, for example in the for of a "system on chip". Other elements of the training coordinator device 110 may be integrated together with the processor 115.

All functions of the training coordinator device 110 may be implemented by means of a suitably programmed conventional computing device such a PC, a PDA, a mobile telephone etc.

The training coordinator device 110 preferably provides feedback on how correct an exercise is performed through the use of different light colors and light effects. The feedback is shown in real time while the exercises are being performed. In addition, feedback is provided on the average results of the performed exercise through the use of a graphical user interface displayed on an internet site.

The correctness of an exercise is determined by the information received from wireless sensors placed either on specific devices or on the body of the user 101. Aspects that affect the interpretation of the correctness may include for example timing of movement, extension of the movement and number of repetitions.

The training coordinator device 110 may have a color light code which is used to score the user performance. Moreover, the device is able to represent the movement of the sensors using lights moving through the device surface. Preferably the patterns thus presented provide useful feedback concerning the information received by the training transducer 102. The training coordinator device 110 uses the lights with the aim of provide the user 101 with feedback on correctness of the movements alerts of incoming events, rewards after completion, decoration, and mood status. The training coordinator device 110 is able to represent exercise specific light patterns over its surface following the movements detected by the sensors. The training coordinator device 110 preferably communicates in real-time with the user 101 through the use of light colors and patterns and a display. The training coordinator device 110 is able to detect some incorrect movements and behaviors of the user 101. The training coordinator device 110 may have pre-stored movement patterns which are used to process the data received from the sensors and display lights codes based on that. The light patterns will indicate the compliance with the exercise, progress of the exercise, reflect the actions registered by the training coordinator device 110, and display trends in exercising. The movement patterns can also be configured through the system's internet interface. By way of example, once such presentation of useful feedback will now be described with reference to FIGS. 2*a*-2*d*.

Figure 2A:
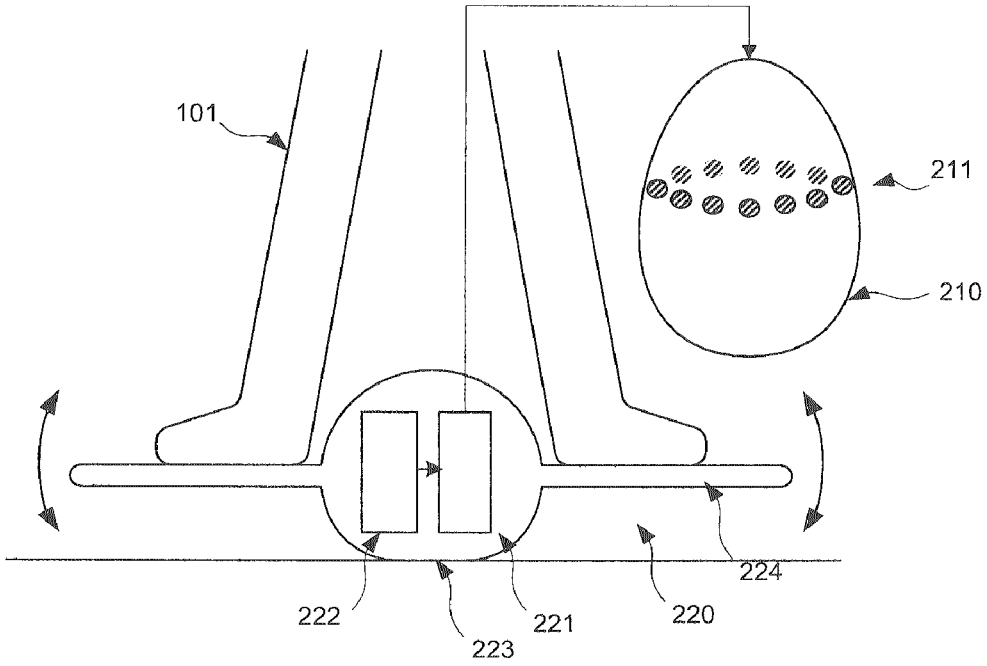
FIG. 2*a* shows a first aspect of a second embodiment.

FIG. 2*a* shows a first aspect of a second embodiment. As shown in FIG. 2*a*, there is provided a "balance board" 220. A balance board is an unstable object upon which a user 101 stands, the intention being for the user to maintain a stable upright stance in spite of the instability of the object. As such, the balance board is an example of an exercise article as above. The balance board may be formed of a pneumatic ball 223 with a rigid concentric ring about its circumference forming a platform 224 to receive a user's feet. The balance board preferably includes a transducer 222 to detect the orientation or movements of the board, and a transmitter 221 to transmit the data from the transducer 222 to the training coordinator device 210 as described above. As shown in FIG. 2*a*, the training coordinator device 210 is ovoid in form, and preferably includes a plurality of luminous transducers 211, in a ring configuration coaxial with the axis of symmetry of the ovoid, and in the prolate portion thereof. As shown in FIG. 2*a*, the platform 224 is horizontal.

Figure 2B:
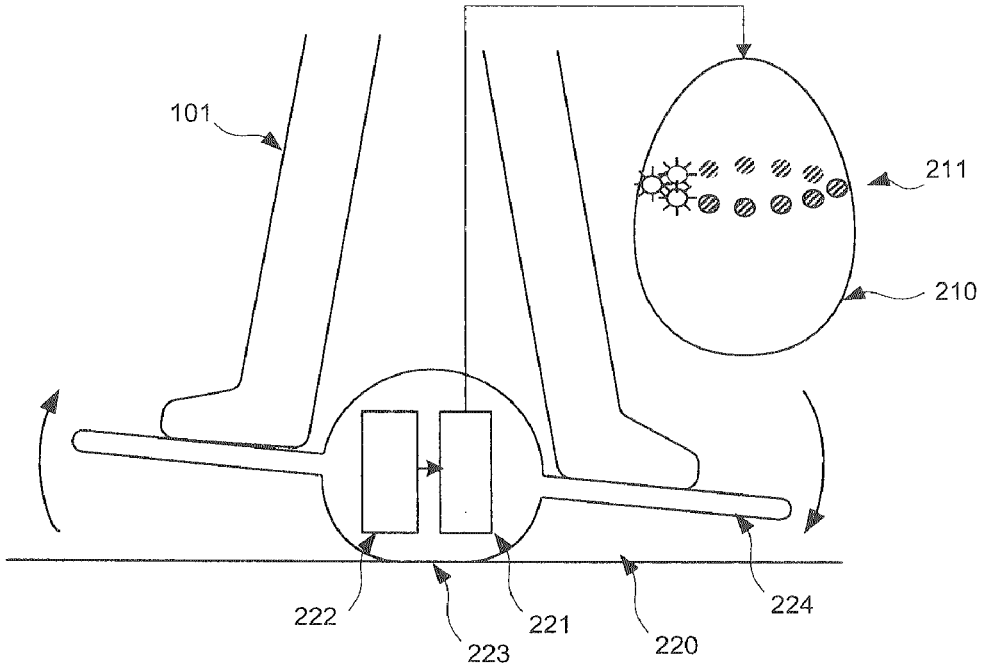
FIG. 2*b* shows a second aspect of the second embodiment.

FIG. 2*b* shows a second aspect of a second embodiment. Turning now to FIG. 2*b*, there is shown the same arrangement as described with regard to FIG. 2*a*. It will be noted, however, that as shown in FIG. 2*b* the annular platform 224 is no longer horizontal, as a result of imperfect control by the user 101. This fact is detected by the transducer 222 and relayed to the first interface 112 of the training coordinator device 210 by the transmitter 221. The processor 115 compares the information thus received with criteria derived from the training schedule stored in the first memory 116, which may define criteria such as the maximum permitted deviation from the horizontal, the maximum duration of an unbalanced condition, the maximum rate of change in the balance condition etc. Based on this comparison, output data is determined and sent to the first output 111 or saved to the second memory 114. For example, as shown in FIG. 2*a* certain luminous transducers in the array of transducers 221 are illuminated to identify the uppermost edge of the balance board, which as shown in FIG. 2*b* as the leftmost edge of the platform, to the user by lighting up in a corresponding position, i.e., the luminous transducers on the left hand side of the training coordinator device 210. Further information from the determination made by the processor 115 may be relayed by controlling a flashing rate or pattern of the luminous transducers, or their color. For example, green lights might be used to indicate that variations are within acceptable limits, and red lights to warn the user that acceptable limits have been exceeded. The rate of flashing of the lights might be increased continuously throughout an exercise period as a reflection of the time remaining, etc. Countless other such representations will occur to the skilled person.

Figure 2C:
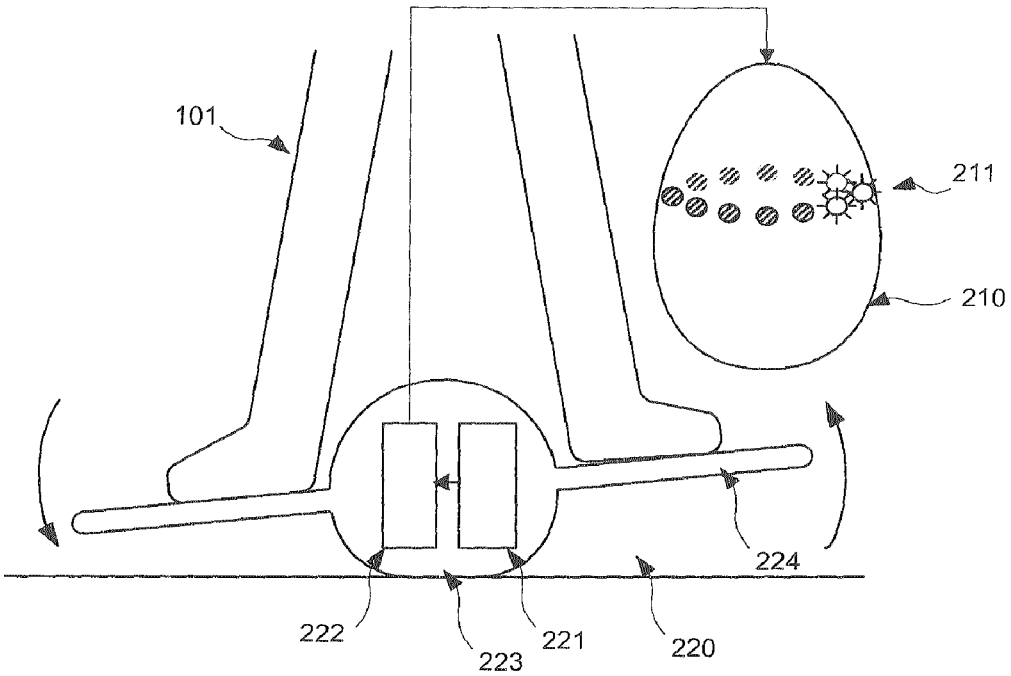
FIG. 2*c* shows a third aspect of the second embodiment.

FIG. 2*c* shows a third aspect of the second embodiment. FIG. 2*c* further exemplifies the behavior of the training coordinator device 210 as described with respect to FIG. 2*b*, by showing how where an unbalanced condition leads to the rightmost edge of the platform being uppermost, the rightmost elements of the array of luminous transducers 211 is illuminated.

Figure 2D:
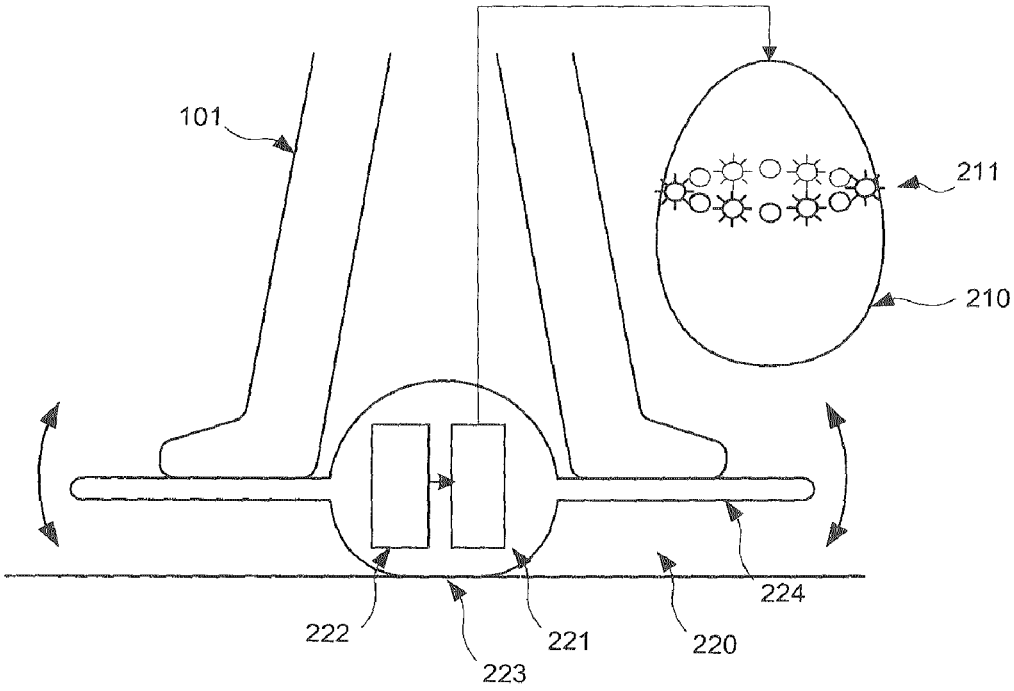
FIG. 2*d* shows a fourth aspect of the second embodiment.

FIG. 2*d* shows a fourth aspect of the second embodiment. FIG. 2*d* further exemplifies the behavior of the training coordinator device 210 as described with respect to FIG. 2*b*, by showing how where a balanced condition is achieved, evenly distributed elements of the array of luminous transducers 211 are illuminated, to indicate this to the user. The pattern of the lights may be changed to indicate for how long this condition has been maintained.

FIGS. 3*a* to 3*f* show further developments of the feedback mechanisms that may be employed by the training coordinator device 210. Specifically, FIGS. 3*a* to 3*f* show a sequence of feedback patterns further developing some of the feedback mechanisms that may be found to be useful. Each of FIGS. 3*a* to 3*f* represents a top or plan view of a training coordinator device 210 as described above. As shown, the training coordinator device includes 47 LEDs, arranged in four concentric circles when viewed from above. Specifically, the outermost ring of LEDs includes 20 LEDs, the second ring of LED includes 16 LEDs, the third ring includes 10 LEDs, and finally there is provided a single central LED. Clearly, the number of LEDs in each ring may be varied as desired. LEDs are particularly well suited in view of their low heat output and good visibility, but other lighting devices may also be found to be suitable. The rings need not be situated in the same plane, for example in the case where an ovoid envelope is adapted; the outer rings may be situated closer to the base of the training coordinator device 210.

Figure 3A:
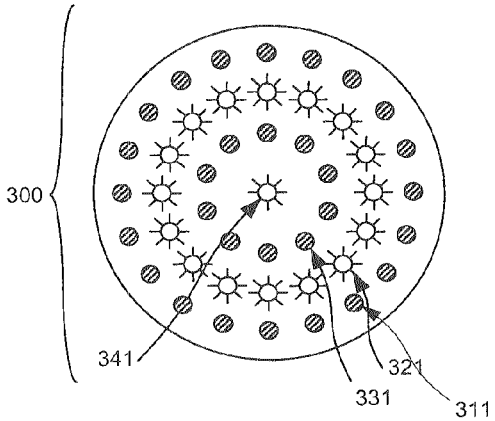
FIGS. 3*a* to 3*f* show further developments of the feedback mechanisms that may be employed by the training coordinator device.

As shown in FIG. 3*a*, the LEDs of the outer ring and third ring are not illuminated, whilst the LEDs of the second and central ring are illuminated. The outer ring includes a first outer ring LED 311. The second ring includes a first second ring LED 321. The third ring includes a first third ring LED 331. The LED in the centre is denoted with the reference 341. This numbering is retained for the remaining drawings of FIGS. 3*b*-3*f*. In the following description of the remaining drawings, any LEDs not explicitly describes as being illuminated in any given drawing may be assumed to be extinguished.

Figure 3B:
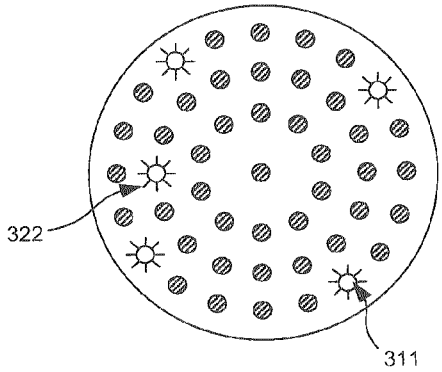

Now let us imagine that the training coordinator device 210 is connected to a balance board exercise article containing a training transducer 222 as described above, and a user 101 begins a balancing exercise. FIG. 3*b* shows an exemplary feedback situation at the beginning of such an exercise. According to the illustrated approach, the outer ring is used to provide time feedback to the user 101. As shown, the first outer ring LED 311 is illuminated, as are a further three outer ring LEDs distributed at points 90°, 180° and 270° around the circumference of the outer ring taking the first outer ring LED 311 to be situated at 0°. The outer ring LEDs thus exhibits fourfold symmetry. In this example fourfold symmetry is chosen simply because four is a convenient factor of the number of LEDs in the outer ring. Any factor may be chosen, including 1, although it may be advantageous to select a larger value in cases where the orientation of the device with respect to the user cannot be predicted.

According to the illustrated approach, all rings other than the outer ring are used to provide balance board orientation information to the user 101, with a view to enabling the user 101 to assess his performance as the exercise progresses. A ring of lights can be used to reflect the direction in which the board is tipped at any moment. By adding a plurality of concentric rings, an indication to the degree to which the board is tipped, as well as the direction can be conveyed. According to the arrangement of FIGS. 3*a*-3*f* therefore, the second ring is used to indicate direction when an excessive deviation from the balanced position is detected, the third ring is used when some tipping is detected, but remains within acceptable boundaries, and the central light is illuminated to indicate that perfect balance is achieved. Thus as shown here a second ring LED 322 is illuminated, indicating an excessive tip to the left.

Figure 3C:
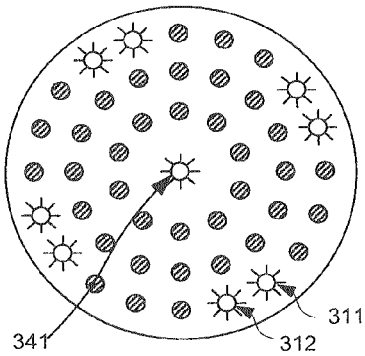

FIG. 3*c* shows a later step in the sequence initiated in FIG. 3*b*. As shown in FIG. 3*c*, in addition to the LED 311, a second outer ring LED 312 immediately adjacent is also illuminated, as are a further three outer ring LEDs distributed at points 90°, 180° and 270° around the circumference of the outer ring taking the second outer ring LED 312 to be situated at 0°. By illuminating additional outer ring LEDs in this manner the passage of time is indicated to the user. Preferably the time between illuminations is proportional to the total planned exercise time, so that by observing the number of LEDs yet to be illuminated the user is also given an indication of the amount of time remaining before the end of the exercise in progress. Furthermore, the light 322 is now extinguished, and the central light 341 illuminated, indicating that the user has successfully corrected the excessive tip reported in FIG. 3*b* and is now correctly balanced.

Figure 3D:
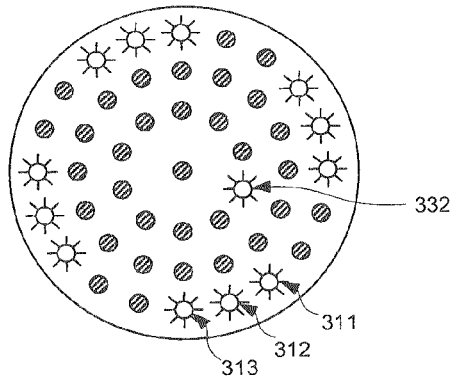

FIG. 3*d* shows a still further step in the sequence described above. As shown in FIG. 3*d*, in addition to the LEDs 311 and 312, a third outer ring LED 313 immediately adjacent is also illuminated, as are a further three outer ring LEDs distributed at points 90°, 180° and 270° around the circumference of the outer ring taking the third outer ring LED 313 to be situated at 0° thereby continuing the illustration of the passage of time. Furthermore, the light 341 is now extinguished, and the third ring light 332 illuminated, indicating that a slight tip has been detected, in this case to the right.

Figure 3E:
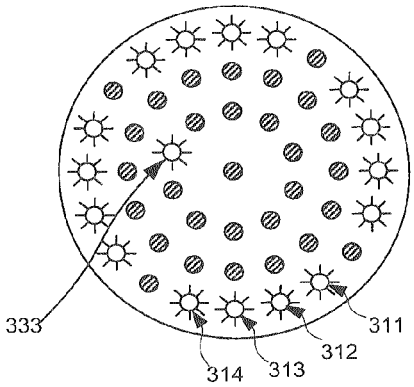

FIG. 3*e* shows a still further step in the sequence described above. As shown in FIG. 3*d*, in addition to the LEDs 311, 312 and 313, a fourth outer ring LED 314 immediately adjacent is also illuminated, as are a further three outer ring LEDs distributed at points 90°, 180° and 270° around the circumference of the outer ring taking the fourth outer ring LED 314 to be situated at 0° thereby continuing the illustration of the passage of time. Furthermore, the light 332 is now extinguished, and the second ring light 333 illuminated, indicating that the user has slightly overcorrected the tip detected and reported in FIG. 3*d*.

Figure 3F:
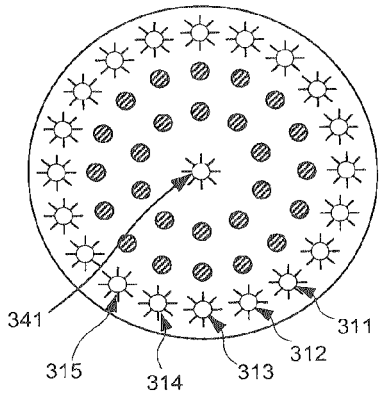

FIG. 3*f* shows a final step in the sequence described above. As shown in FIG. 3*d*, in addition to the LEDs 311, 312, 313 and 314, a fifth outer ring LED 315 immediately adjacent is also illuminated, as are a further three outer ring LEDs distributed at points 90°, 180° and 270° around the circumference of the outer ring taking the fourth outer ring LED 314 to be situated at 0. Accordingly as shown in FIG. 3*f* all LEDs of the outer ring are now illuminated, indicating that the end of the exercise has been reached. Furthermore, the light 333 is now extinguished, and the central light 341 re-illuminated, indicating that the user has recovered the correct position.

Successful completion of an exercise may trigger a special response from the training coordinator device.

It will be appreciated that the manner in which the lights are illuminated in response to different inputs from the training transducer is infinitely variable. As described above, information received from the exercise article will be interpreted as a function of the information defining the exercise article as discussed above, and compared to relevant parts of the training schedule, to determine a response for presentation to the user 101 by the first interface 112. This response is determined by reference to the third set of parameters. These may define reactions such as different light patterns, vibrations, noises, etc. when for example a threshold defined in the training schedule is exceeded by a signal from the exercise device when filtered by the article characteristics defining the exercise article. In the case of the embodiment of FIGS. 3*a*-3*f*, for example, the training schedule may specify the duration for which a user is to carry out the balancing exercise and how much deviation from the vertical (balanced) position is acceptable. When training is initiated, the article definition corresponding to the users balance board will be used to interpret information received from the balance board to derive a measurement of the boards position for comparison to the threshold defined in the training schedule. Finally, the result of the comparison will be used to select an output on the basis of the behavior template. In certain embodiments, the behavior template may simply state that for a given comparison result, such as, for example, in the form of a look-up table, e.g., where the input value exceeds the threshold by a certain percentage, a certain combination of LEDs should be illuminated. Alternatively, mathematical formulae based on the geometry of the LEDs may be defined so that for certain exercise the appropriate LEDs to illuminate may be determined directly by applying a particular function to the interpreted information received from the exercise article. Other lighting effects may be imagined where lights are not simply turned on or off, but are faded out with a particular delay so as to give the impression of the leading light leaving a trail. The timing information need not be limited to the duration of the present exercise, but might also relate to the time until the next exercise session, the time an exercise session is overdue, the period for which the user has successfully maintained a particular condition (such a perfect balance) etc.

According to a further embodiment, the training coordinator device is able to automatically upload data to a remote server with the results of the exercise session. In a similar way, the device is able to update its own schedule automatically downloading data from the server. No connection to another computer device would be needed since the Training coordinator device is able to connect to internet by itself. The data in the server can be accessed and modified through the system's website, using a graphical user interface. The training coordinator device is able to connect to the internet by itself.

According to still further embodiments at the start time of a training session the training coordinator device shows light effects intended to draw the attention of the user and trigger the user to start the training session. When the user starts using the exercise article, the first exercise of the training session starts. During the exercise the training coordinator device gives feedback on the movements detected by the training transducer through light effects. The light effect represents the movement of the training transducer and the correctness of the movement. The training coordinator device lights indicate the progress of the exercise. At the end of the exercise, a reward is given through a light effect, and optional followed by a trigger to start another exercise.

Between the training sessions the training coordinator device can be used as lighting decoration or can have a mood. The mood of the training device will depend on the compliance level to the training schedule and the level of correctness in the exercises.

According to certain embodiments, the training coordinator device is adapted to be operated over a period of several days, weeks, months, or years. The training coordinator device is adapted not only to monitor, record and report on training activities, but also to prompt a user to perform training activities as dictated by the training schedule. As such, the training coordinator device provides persistent and real time information to the user concerning his or her training regime. The training coordinator device reminds and motivates by changing colors and vibration to do the exercises. The user receives feedback if he does the exercise well, or suggests corrections. The user can see his progress on a web site.

According to certain embodiments, there is provided a training coordinator device in communication with a training transducer integrated in an exercise device. The training coordinator device receives training schedule data for example via an internet link, and uses this schedule to prompt and encourage in a real time and persistent manner a user in performing training activities defined in the training schedule by means of a user interface for example taking the form of an LED array. The training coordinator device by wireless means, monitors training activities by means of signals from a suitably adapted training transducer, preferably which may be integrated in an exercise device such as a bicycle etc. Information concerning the user's training activities are published for example by means of an internet link for access by both the user and medical professionals, who may also be the source of the training schedule.

Although the embodiments described above relate primarily to physical training, embodiments relating to other training activities may be envisaged, for example weight loss, musical instrument practice, etc. As such the term training may be interpreted as the action of teaching a person or animal a particular skill or type of behavior. Similarly, the term exercise article need not be limited to physical exercise, but to any article used in the acquisition or measurement of progress in such training activities, The skilled person will appreciate that the various embodiments described above incorporate numerous interchangeable features which may be combined in a number of ways.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening networks (e.g. public networks). Modems, cable modem and Ethernet cards are just a few of the currently available types of network adapters.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A computer program product, comprising a computer readable tangible storage device having computer readable program code stored therein, said program code configured to be executed by a processor to implement a method of training, said method comprising:

said processor receiving signals from a training transducer at a first interface;

said processor receiving training schedule data from a remote correspondent at a second interface, the training schedule data defining times by which a specified exercise is to be performed by a user;

said processor storing said training schedule data in a first memory;

said processor outputting a human perceptible signal in accordance with a feedback template, said human perceptible signal comprising data content relating to performance of the exercise by the user, said feedback template specifying a manner in which the data content is to be conveyed to the user;

said processor storing, in a second memory, output status data from which the human perceptible signal is generated;

said processor continuously (i) carrying out a determination, in real time as the user is performing the exercise, of whether said signals received at said first interface satisfy criteria of conforming to said training schedule data with regard to a time value obtained from a clock; and (ii) updating said training schedule data as a function of a result of said determination;

wherein a training device comprises the first interface, the second interface, the first memory, the second memory, the processor, and the clock;

wherein the processor is directly connected to the first interface via a unidirectional first link in which data can flow only from the first interface to the processor;

wherein the processor is directly connected to the second interface via a bidirectional second link in which data can flow from the second interface to the processor or from the processor to the second interface;

wherein the processor is directly connected to the first output via a unidirectional third link in which data can flow only from the from the processor to the first output;

wherein the processor is directly connected to the first memory via a bidirectional fourth link in which data can flow from the first memory to the processor or from the processor to the first memory;

wherein the processor is directly connected to the second memory via a unidirectional fifth link in which data can flow only from the second memory to the processor;

wherein the processor is directly connected to the clock via a unidirectional sixth link in which data can flow only from the clock to the processor.

2. A computer program product, comprising a computer readable tangible storage device having computer readable program code stored therein, said program code configured to be executed by a processor to implement a method of training, said method comprising:

said processor receiving signals from a training transducer at a first interface;

said processor receiving training schedule data from a remote correspondent at a second interface, the training schedule data defining times by which a specified exercise is to be performed by a user;

said processor storing said training schedule data in a first memory;

said processor outputting a human perceptible signal in accordance with a feedback template, said human perceptible signal comprising data content relating to performance of the exercise by the user, said feedback template specifying a manner in which the data content is to be conveyed to the user;

said processor storing, in a second memory, output status data from which the human perceptible signal is generated;

said processor continuously (i) carrying out a determination, in real time as the user is performing the exercise, of whether said signals received at said first interface satisfy criteria of conforming to said training schedule data with regard to a time value obtained from a clock; and (ii) updating said training schedule data as a function of a result of said determination;

wherein a training device comprises the first interface, the second interface, the first memory, the second memory, the processor, and the clock;

wherein the first output comprises a plurality of luminous transducers, wherein the luminous transducers may be independently illuminated or not illuminated, said method further comprising:

conveying the data content to the user in the human perceptible signal while the exercise is being performed by the user, wherein the data content is feedback on how correct the exercise is being performed, and wherein the feedback on how correct the exercise being performed is conveyed to the user through a pattern of illumination of the luminous transducers.

3. The computer program product of claim 2, wherein the feedback on how correct the exercise is being performed is further conveyed to the user through usage of different light colors within the pattern of illumination.

4. The computer program product of claim 2, wherein the plurality of luminous transducers are distributed in at least one ring of luminous transducers.

5. The computer program product of claim 4, said method further comprising:

said processor selectively illuminating a number of luminous transducers in a timing ring of the at least one ring such that the number of luminous transducers in the timing ring that are illuminated at a present time is indicative of a time duration of said performance of the exercise by the user from a time at which said performance of the exercise by the user was initiated until the present time, and wherein the number of luminous transducers in the timing ring is at least two.

6. The computer program product of claim 5, wherein the number of luminous transducers in the timing ring that are illuminated increases as the time duration of said performance of the exercise by the user increases.

7. The computer program product of claim 5, wherein the at least one ring of luminous transducers is a plurality of rings of luminous transducers, and wherein the timing ring is a first ring of the plurality of rings.

8. The computer program product of claim 7, wherein the exercise is performed by the user on a balance board.

9. The computer program product of claim 8, wherein the plurality of rings comprises a central ring consisting of a single luminous transducer that is concentric with respect to the rings of the plurality of rings, wherein the processor is configured to illuminate the single luminous transducer during said performance of the exercise by the user when a perfect balance of the balance board is achieved, and wherein the processor is configured to prevent the single luminous transducer from being illuminated during said performance of the exercise by the user when said perfect balance of the balance board is not achieved.

10. The computer program product of claim 8, wherein the plurality of rings comprises a second ring and a third ring, wherein the second ring and the third ring each independently comprise two or more luminous transducers, wherein a distribution of illumination of the luminous transducers in the second ring is indicative of a direction in which the balance board is tipped, and wherein a distribution of illumination of the luminous transducers in the third ring is indicative of a degree to which the balance board is tipped.

* * * * *